US007156081B2

(12) United States Patent
Ratner

(10) Patent No.: US 7,156,081 B2
(45) **Date of Patent: *Jan. 2, 2007**

(54) FUEL CONDITIONING ASSEMBLY

(75) Inventor: Lee Ratner, deceased, late of Wellington, FL (US); by Joel S. Ratner, legal representative, Wellington, FL (US)

(73) Assignee: Royce Walker & Co., Ltd., Nassau (BS)

( * ) Notice: Subject to any disclaimer, the term of this patent is extended or adjusted under 35 U.S.C. 154(b) by 105 days.

This patent is subject to a terminal disclaimer.

(21) Appl. No.: 10/940,405

(22) Filed: Sep. 14, 2004

(65) Prior Publication Data

US 2005/0145225 A1 Jul. 7, 2005

Related U.S. Application Data

(63) Continuation-in-part of application No. 10/419,655, filed on Apr. 21, 2003, now Pat. No. 6,915,789, which is a continuation-in-part of application No. 09/934,229, filed on Aug. 21, 2001, now Pat. No. 6,550,460, which is a continuation-in-part of application No. 09/557,705, filed on Apr. 25, 2000, now Pat. No. 6,276,346, which is a continuation-in-part of application No. 09/249,878, filed on Feb. 16, 1999, now Pat. No. 6,053,152, which is a continuation-in-part of application No. 08/782,348, filed on Jan. 13, 1997, now Pat. No. 5,871,000.

(51) Int. Cl.
*F02M 33/00* (2006.01)

(52) U.S. Cl. ..... 123/538

(58) Field of Classification Search ..... 123/536–538, 123/568.11–568.32
See application file for complete search history.

(56) References Cited

U.S. PATENT DOCUMENTS 2,033,753 A 3/1936 Bucklen (Continued)

*Primary Examiner*—Marguerite McMahon
(74) *Attorney, Agent, or Firm*—Malloy & Malloy, P.A.

(57) ABSTRACT

A fuel conditioning assembly having an elongated housing with an inlet, an outlet, and a flow through passage there between. The inlet is coupled with a fuel supply so as to receive fuel flow there through into the flow through passage, wherein a turbulent flow of the fuel is initiated and the fuel is influenced by a combination of elements, in compound or elemental form, some of which are maintained in a select location within the flow through passage by a binding element. These elements may include copper, aluminum, stainless steel, titanium, magnesium, barium, calcium, iron, zirconium, cerium, platinum, and/or palladium which chemically condition the fuel flowing through the flow through passage by rearranging the molecular bonds of the fuel with a catalytic effect. The fuel, regardless of its type is dispersed into very small droplets having high surface areas thereby lowering the vapor density of the fuel and substantially increasing a fuel burn efficiency. Further, the reaction of a variety of these elements, at least with one another, serves to create an electrostatic charge that is conveyed through the flow through passage by an elongate segment and causes fuel molecules to repel one another resulting in the aforementioned catalytic effect and conditioning of the fuel as it passes through the outlet into to any of a variety of fuel combustion assemblies.

18 Claims, 4 Drawing Sheets

U.S. PATENT DOCUMENTS 2,231,605 A 2/1941 Stephenson et al.
2,999,485 A 9/1961 Lundy et al.
4,335,698 A * 6/1982 Stephens ..... 123/537
4,381,754 A * 5/1983 Heckel ..... 123/538
4,798,191 A 1/1989 King
4,930,483 A 6/1990 Jones
5,044,347 A 9/1991 Ullrich et al.
5,069,190 A 12/1991 Richards
5,074,273 A 12/1991 Brown
5,076,246 A 12/1991 Onyszczuk
5,092,303 A 3/1992 Brown
5,154,153 A 10/1992 MacGregor
5,167,782 A 12/1992 Marlow
5,197,446 A 3/1993 Daywalt et al.
5,305,725 A 4/1994 Marlow
5,307,779 A 5/1994 Wood et al.
5,342,586 A 8/1994 Park
5,393,723 A 2/1995 Finkl
5,447,625 A 9/1995 Roe
5,524,594 A 6/1996 D'Alessandro
5,871,000 A 2/1999 Ratner
5,881,702 A 3/1999 Arkfeld
6,000,381 A 12/1999 Berlin et al.
6,053,152 A 4/2000 Ratner
6,276,346 B1 8/2001 Ratner et al.
6,306,185 B1 10/2001 Berlin et al.
6,550,460 B1 4/2003 Ratner et al.

* cited by examiner

FUEL CONDITIONING ASSEMBLY

CLAIM OF PRIORITY

The present application is a Continuation-In-Part of U.S. patent application Ser. No. 10/419,655, filed on Apr. 21, 2003 now U.S. Pat. No. 6,915,789, which is a Continuation-In-Part of U.S. patent application Ser. No. 09/934,229, filed on Aug. 21, 2001 now U.S. Pat. No. 6,650,460, which is a Continuation-In-Part application of Ser. No. 09/557,705 filed on Apr. 25, 2000, which matured into U.S. Pat. No. 6,276,346 on Aug. 21, 2001, which is a Continuation-In-Part application of Ser. No. 09/249,878 filed on Feb. 16, 1999, which matured into U.S. Pat. No. 6,053,152 on Apr. 25, 2000, which is a Continuation-In-Part of Ser. No. 08/782,348 filed on Jan. 13, 1997, now U.S. Pat. No. 5,871,000 issued on Feb. 16, 1999, wherein all of the above are incorporated herein, in their entirety, by reference.

BACKGROUND OF THE INVENTION

1. Field of the Invention

The present invention relates to a fuel conditioning assembly for use in a fuel combustion system, which is substantially easy to install and maintenance free, and is structured to provide a more complete combustion of fuel, regardless of the type of fuel utilized, reduce the emission of pollutants, provide a cleaner running system, which requires less maintenance, and significantly increase fuel efficiency.

2. Description of the Related Art

The natural inefficiency inherent in fuel combustion systems, such as internal combustion engines, is well documented. Specifically, internal combustion engines utilizing fossil fuels and other combustion systems using a variety of different types of fuels and fuel mixtures typically emit unburned or under-burned fuel from the exhaust as well as the undesirable by-products of combustion. This under-burning of fuel causes severe environmental problems as the resultant pollutants, some of which are thought to be cancer causing, are emitted directly into the atmosphere. In addition to being emitted directly into the atmosphere through the exhaust, many by-products of fuel combustion simply accumulate on internal engine components, with often 30% of the exhaust being directed into the engine. This causes those engine components to wear out sooner and require frequent maintenance and repairs which can lead to shortened total engine life. Furthermore, the incomplete combustion of fuel within an engine substantially under-utilizes the energy capacity of the fuel. Specifically, in addition to the environmental concerns due to pollution attributed to the under-utilization of the energy capacity of fuel, there are also resultant losses in economic efficiency due to higher fuel and maintenance expenses as well as a generally shorter engine life.

Others in the art have developed various fuel conditioning assemblies in an attempt to alleviate some of the above-mentioned problems. For example, in the past various types of heating devices were incorporated into a fuel conditioning assembly so as to raise the temperature of the fuel and thereby improve the combustion properties of the fuel. Specifically, such devices include a heating element which comes into contact with the fuel so as to raise it's temperature and consequently reduce the density of the fuel. Of course, such a procedure can also raise the engine temperature and can prove quite hazardous. Additionally, others in the art have attempted to add various types of additives to the fuel in an attempt to positively effectuate improvement in the fuel's combustion properties. Such additives have included the addition of minute quantities of Cupric salts, for example, to the fuel supply. Unfortunately, however, it can be difficult to obtain and consistently add those additives in an efficient manner. Also, if the additives are not completely soluble in the fuel, they may be quite harmful to the engine. Accordingly, none of these devices have actually been successfully and practically incorporated with a combustion engine in a simple, economical, and maintenance free manner.

In addition to the above-referenced approaches, others in the art have sought to introduce various metals, in combination, within a flow of fuel in an attempt to generate a chemical reaction which effects the combustion properties of the fuel. Although some of these devices do improve the combustion properties of the fuel somewhat, those skilled in the art have not been successful in substantially increasing the combustion properties in a practical and effective manner. In particular, such devices have been unable to effectuate a substantial improvement such as would be necessary to offset the price of purchase and installation of the device into existing engines. Indeed, the improved combustion properties provided by existing fuel conditioning assemblies are so slight that a user may find it more economical to increase the combustion properties of the fuel simply by switching to a higher octane rated fuel or by mixing the fuel with an additive.

Accordingly, there is still a need in the art for a practical and cost-effective fuel conditioning assembly which reduces visible smoke as well as other pollutants being discharged through the exhaust, increases fuel efficiency (as quantified in miles per gallon), provides for a cleaner running engine requiring less maintenance, extends the useful life of engine components, is substantially maintenance free, and is substantially easy and safe to implement with existing engine designs. Furthermore, such a fuel conditioning system should be effectively employable in other combustion systems and applications, such as a fuel burning furnace, wherein the efficiency and nature of the combustion is significant for the ultimate output to be achieved.

SUMMARY OF THE INVENTION

The present invention is directed towards a fuel conditioning assembly that is structured to be positioned between a fuel supply and a fuel combustion assembly. In particular, the fuel conditioning assembly of the present invention includes a preferably rigid housing having an inlet, an outlet, and a flow through passage where through fluid can flow from the inlet to the outlet.

The fuel conditioning assembly is structured to chemically condition the fuel as it travels through the flow through passage. At least one preferred embodiment of the conditioning assembly of the present invention is structured to rearrange the molecular bonds of the fuel, such as through the generation of an electrostatic charge, with a catalytic effect that results in molecular repulsion which separates the fuel particles into a plurality of subatomic particles, thereby reducing the density of the fuel and substantially increasing a fuel burn efficiency. As used herein, the term subatomic particles is intended to describe the atomization of the fuel, which leads to turbulence and the subsequent formation of separated molecules of fuel with a lower vapor density resulting in better combustion. Further, the construction and resulting performance characteristics of at least one preferred embodiment of the present invention results in an "atomization" or dispersion of any of a variety of fuels which may be utilized when practicing the present invention. As set forth in greater detail herein the fuel may include, but not be limited to, gasoline, diesel, bio-diesel, etc. As a result of the aforementioned atomization or dispersion, the fuel is transformed into small droplets having a high surface area thereby lowering the fuel vapor density and increasing the completeness of fuel combustion.

The inlet of the housing is coupled, directly or indirectly, with the fuel supply so as to receive fuel there through into the flow through passage. As such, a generally continuous flow of fuel passes into the housing when the fuel system is operational. Similarly, the outlet of the housing is coupled with the fuel combustion assembly so as to receive the flow of conditioned fuel exiting the housing. As also described in greater detail hereinafter structural features of the housing, in at least one preferred embodiment thereof, may include a screen structure formed of a stainless steel, aluminum composite or other predetermined material. The screen is disposed in interruptive relation with the flow of fuel through the housing and is structured to produce additional turbulent mixing of the fuel. As a result, the treated fuel mixture has a lowered fuel vapor density, as set forth above, which further facilitates a more efficient burn of the fuel. Moreover, in such a preferred embodiment an elongate element formed at least in part of copper extends along a substantial portion of the flow through passage, thereby helping to conduct a generated electrostatic charge throughout, and in turn maximizing the beneficial effects of the present fuel conditioning assembly.

Therefore, it is an object of the present invention to provide a fuel conditioning assembly which rearranges the molecular bonds of a fuel with a catalytic effect and separates fuel particles into a plurality of subatomic particles so as to reduce the density of the fuel and thereby increase the completeness of a burn of the fuel. Again for purposes of clarity and emphasis, subatomic particles is a term used to describe the atomization of the fuel which leads to its turbulence and subsequent formation of separated molecules of fuel with a lower vapor density, resulting in better combustion.

A further object of the present invention is to provide a fuel conditioning assembly which provides for more complete combustion of fuel and thereby reduces the emission of fuel from the exhaust as well as the emission of smoke, fumes, etc, as part of the exhaust.

Another object of the present invention is to provide a fuel conditioning assembly which provides for more complete combustion and cleaner burning of fuel so as to provide a cleaner running engine requiring less maintenance.

An additional object of the present invention is to provide a fuel conditioning assembly which increases the fuel efficiency of a vehicle, as measured in miles per gallon, for example.

It is a further object of the present invention to provide a fuel conditioning assembly which is substantially rugged and durable for heavy duty use and does not contain any moving parts or electrical connections which can be damaged or wear out over time.

It is also an object of the present invention to provide a fuel conditioning assembly which is substantially maintenance free.

Yet another object of the present invention is to provide a fuel conditioning system which recognizes and utilizes an ideal combination of elements in order to maximize the effectiveness of the chemical reaction which conditions the fuel.

An added object of the present invention is to provide a fuel conditioning assembly that provided beneficial effects in a variety of different types of combustion systems which use a variety of different fuels, by pre-conditioning the fuel prior to combustion.

These and other objects, features, and advantages of the present invention will become more readily apparent from the attached drawings and the detailed description of the preferred embodiments, which follows:

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Shown throughout the figures, the present invention is directed towards a fuel conditioning assembly, generally indicated as 10. The fuel conditioning assembly 10 is structured to be connected in line with an engine or other combustion based system's fuel system in order to effectively treat and condition the fuel prior to its combustion therein, thereby ensuring that a more effective, more efficient burn is achieved.

Figure 2:
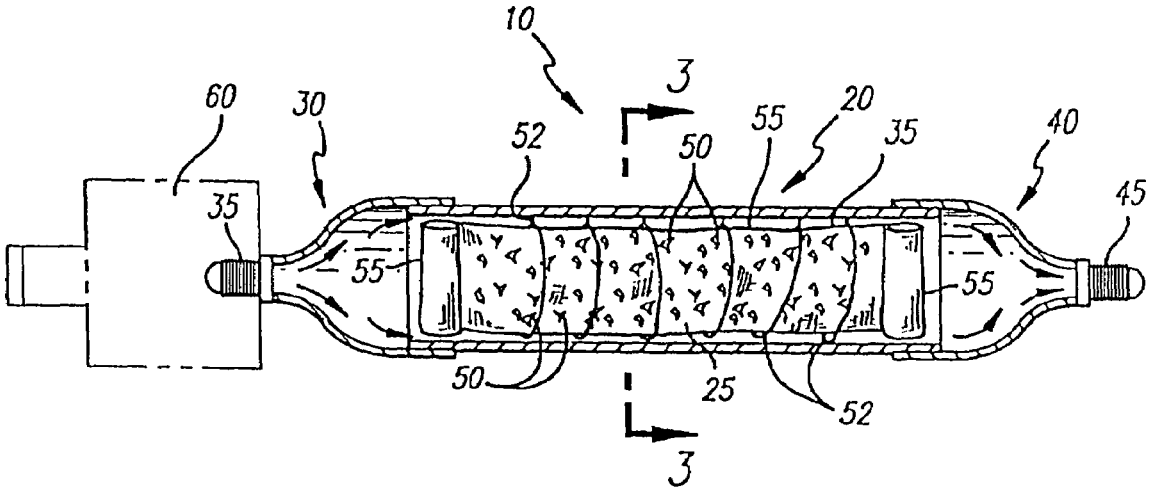
FIG. 2 is a cross-sectional side view of a first embodiment of the fuel conditioning assembly.
Figure 3:
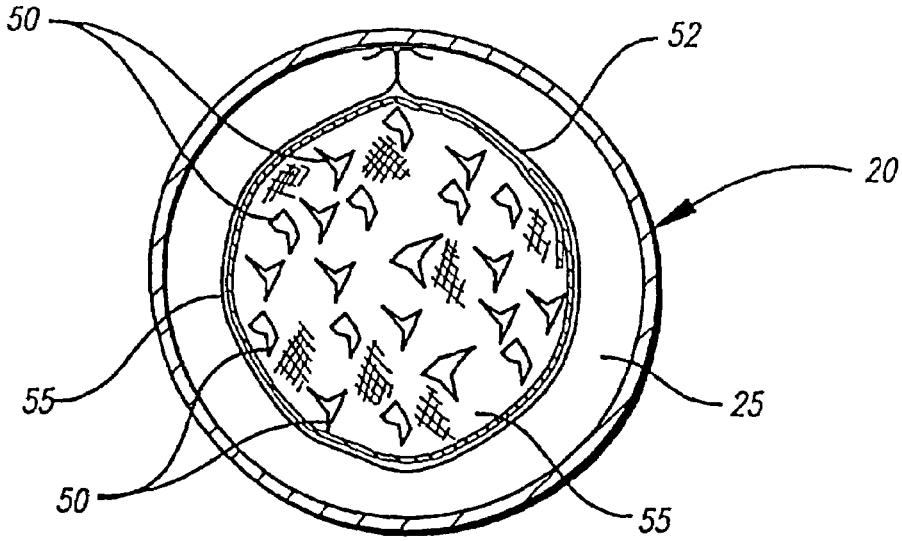
FIG. 3 is a cross-sectional view taken along line 3—3 of FIG. 2.

In particular, the fuel conditioning assembly 10 includes a housing 20, as shown in the figures. The housing 20, which includes an inlet 30, an outlet 40, is preferably rigid in construction, and includes a generally tubular configuration. The inlet and outlet 30 and 40 may be defined by separate elements fitted onto a main body, or a single cast element generally defining the entire housing 20 may be utilized. Moreover, extending from the inlet 30 of the housing to its outlet 40 is a flow through passage 25, as best shown in FIGS. 2 and 3. As such, fuel is able to pass through the housing 20 where it can be effectively conditioned as a result of the present invention. In one preferred embodiment, the housing 20 is formed of Copper, for reasons to be described subsequently. However, other, preferably rigid, materials including metal and/or plastic materials may also be utilized effectively.

Figure 1:
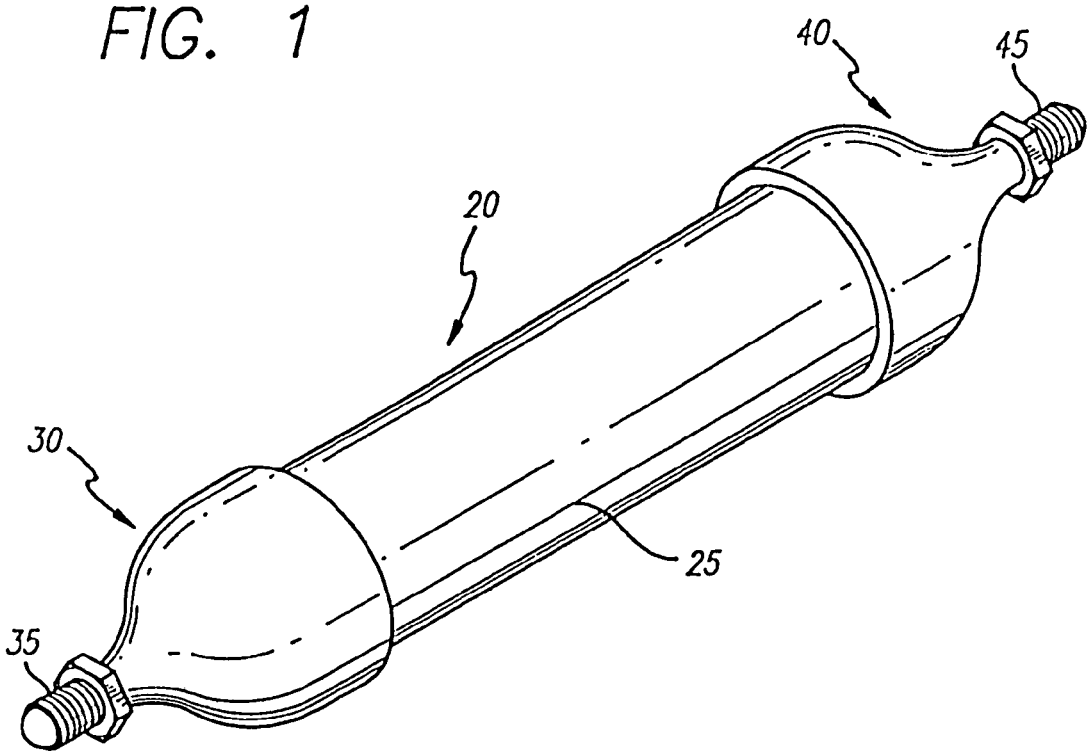
FIG. 1 is a perspective view of the fuel conditioning assembly.

Furthermore, the housing 20 preferably includes a generally elongate tubular configuration, as shown in FIGS. 1 and 2, so as to facilitate a desired residence time in which the fuel is within the flow through passage 25 of the housing 20 and is being conditioned. Of course, the length of the housing 20 may be altered to suit particular situations in which more or less conditioning is desired, and also so as to accommodate for the capacity and size requirements of specific engine types and combustion systems. For example, by increasing the length of the housing 20, and therefore the flow through passage 25, the average residence time of a given quantity of fuel is increased and the fuel conditioning reaction which takes place is maximized.

Looking specifically to the inlet end 30 of the housing 20, it is coupled, either directly or indirectly, with a fuel supply of the engine or other combustion system. As such, the inlet end 30 of the housing 20 receives a consistent flow of fuel there through, wherein the fuel is directed into the flow through passage 25 during normal operation of the combustion fuel system. In order to facilitate a substantially tight and leak-proof connection with the fuel supply, the inlet end 30 is preferably outfitted with an inlet nozzle member 35. The inlet nozzle member 35 will preferably be threaded so as to securely, yet removably, engage a fuel line of the fuel supply of the engine. As such the fuel line may be removably secured to the housing 20 and define a substantially tight, fluid impervious connection with the inlet end 30.

In at least one preferred embodiment of the present invention, the inlet nozzle member 35 is snap-fitted onto the housing 20. However, other means of securing the inlet nozzle member 35 to the housing 20 may be utilized without departing from the intended scope of the present invention. Alternatively, the inlet portion 30 may be integrally formed on the housing 20, in communication with the flow through passage 25, or otherwise permanently secured thereto. Furthermore, the inlet end 30 of the housing 20 is preferably structured to permit fuel to flow into and through the flow through passage 25 of the housing 20 at an inlet pressure of between 40 and 60 psi, thereby maintaining a consistent and sufficient flow of fuel therethrough for use in the combustion process. Additionally, in one preferred embodiment, a fuel filter 60 may be provided and coupled in fluid flow communication with the inlet end 30 of the housing 20, as shown in FIG. 2. As such, prior to the fuel's entry into the housing 20 where it will be conditioned, the fuel is filtered to remove a variety of particle impurities.

Looking now to the outlet end 40 of the housing 20, it is coupled with the fuel combustion assembly (not shown for purposes clarity) of the engine or other combustion system so as to provide for the flow of conditioned fuel thereto for its subsequent combustion. Like the inlet end 30, the outlet end 40 can be removably secured to the flow through passage 25 of the housing 20 or integrally formed therewith. Moreover, an outlet nozzle member 45 may be provided so as to further define the outlet end 40 of the housing 20. The outlet nozzle member 45 is preferably secured to the housing 20 by a substantially tight and leak-proof connection similar to the snap-fit connection preferably utilized in securing the inlet nozzle member 35 of the inlet end 30 to the housing 20. Alternatively, however, the outlet end 40 may be integrally formed with the housing 20 in communication with the flow through passage 25, and/or be otherwise permanently secured thereto. In the preferred embodiment, the outlet nozzle member 45 of the outlet end 40 is externally threaded and is structured to be coupled in direct fluid flow communication with the fuel combustion assembly by a segment of tubing, thereby assuring that the conditioned fuel is combusted substantially in a conditioned state and does not have sufficient time to begin to return to a normal un-conditioned state. Indeed, a separation of only approximately six inches is preferred. Further, it is noted that even though it may be preferred that the inlet and outlet be disposed at opposite ends of the flow through passage, alternate configurations wherein fuel passes into the flow through passage for a period of time and then flows out of an outlet disposed at any location relative to the inlet, may also be utilized.

The fuel conditioning assembly 10 further includes a conditioning assembly. Specifically, the conditioning assembly is defined in the flow through passage 25 and is structured to at least temporarily chemically condition the fuel flowing through the flow through passage 25. In particular, the conditioning assembly is structured and disposed so as to rearrange the molecular bonds of the fuel with a catalytic effect, and separate the fuel particles into a plurality of subatomic particles. The term subatomic particles, as used herein, is meant to describe the atomization of the fuel, which leads to its turbulence and subsequent formation of separated molecules of fuel with a lower vapor density and a better combustion. Furthermore, in a preferred embodiment, the conditioning may include the generation of an electrostatic charge that results in a repulsion of fuel molecules relative to one another so as to achieve the referenced conditioning. Therefore, as a result of this conditioning of the fuel, the fuel's density is reduced and the burning efficiency of the fuel is substantially increased. More particularly, as the fuel is treated by the conditioning assembly during its passage through the housing 20 the less dense, more dispersed fuel is able to more completely burn, as a majority of the fuel molecules are subjected to the combustion reaction. As a result of a more complete burn of the conditioned fuel, energy output and efficiency is increased prior to exhaust. More specifically, conditioning of the fuel in accordance with the present invention, has the two-fold effect of increasing the energy that results from the burn, thereby increasing the fuel efficiency, and reducing the harmful particulate materials or other contaminants that are normally present in the exhaust emissions. Therefore, the combustion system operates on a cleaner basis and is maintained in operating condition longer, while reducing the environmental pollutants present in the exhaust fumes.

Figure 5:
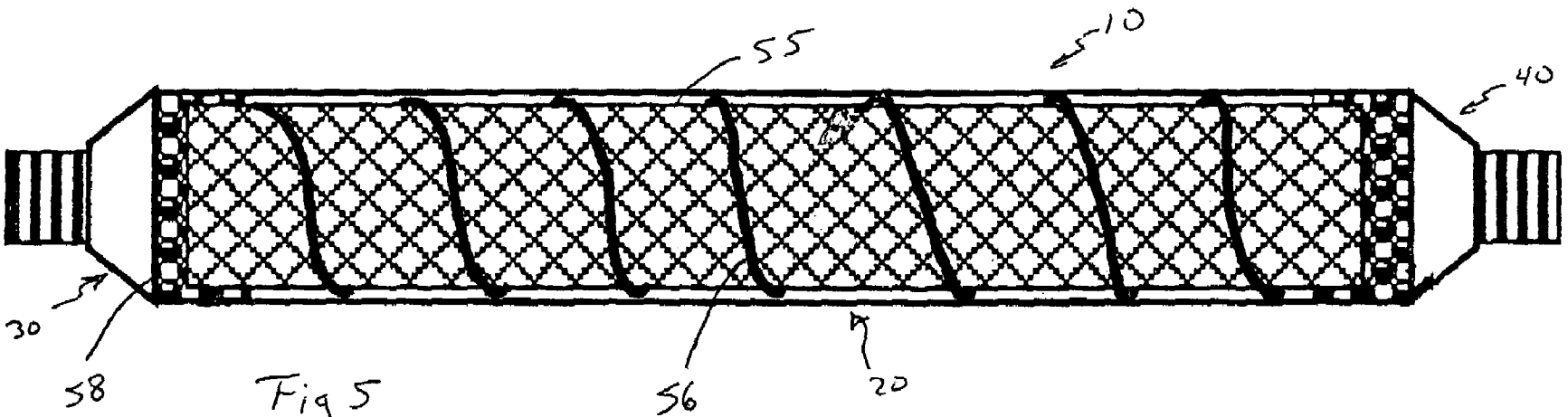
FIG. 5 is a cross-sectional side view of still another embodiment of the fuel conditioning assembly.

In particular, the conditioning assembly preferably includes a turbulence assembly, which is structured to create a turbulent flow of the fuel within the flow through passage 25. The turbulence assembly is structured to substantially agitate the fuel flowing through the flow through passage 25 and thereby substantially enhance the effects of the conditioning by ensuring that the fuel particulates are substantially dispersed and are fully influenced by the conditioning elements present within the flow through passage 25 and responsible for the conditioning to be achieved. In the preferred embodiment, the turbulence assembly includes a plurality of particulates disposed within the flow through passage 25 and structured to create turbulence in the fuel as it flows there through from the inlet end 30 to the outlet end 40 of the housing 20, as best shown in FIG. 2. Moreover, it is preferred that the plurality of particulates include metal shavings 50. Specifically, the entangled, random and dense configuration of an agglomeration of metallic shavings achieves a maximum turbulent effect as the fuel is pushed there through and is continuously re-routed. In the preferred embodiment, the plurality of metal shavings 50 are formed of stainless steel. Moreover, in one preferred embodiment, the metal shavings 50 are enclosed within a mesh or screen 55, as best shown in FIGS. 2, 3 and 5.

Specifically, the mesh or screen 55 is structured in a generally net-like configuration so that it effectively retains the metal shavings 50 therein and provides a substantially large surface area for contacting the fuel. Moreover, the mesh 55 is oriented inside the housing 20 so as to permit the fuel to flow freely there through, and through the plurality of metal shavings 50, without allowing any of the metal shavings 50 to exit the housing 20 with the conditioned fuel. In the preferred embodiment, the mesh 55 is formed of Aluminum, although other materials may also be utilized. In the illustrated embodiment, a plurality of wire loops 52 or like fasteners are disposed with the mesh 55, so as to facilitate conditioning and turbulence of the fuel as well as help keep the mesh 55 disposed around the metal shavings 55.

In addition to the turbulence assembly, the conditioning assembly further includes a plurality of metallic elements structured to come into contact with the turbulent flow of fuel through the flow through passage 25 of the housing 20 and cause a catalytic effect in the fuel flow. In particular, the metallic elements of the preferred embodiment which cause the catalytic effect include copper, aluminum and stainless steel, which when all are present and come into contact with a flow of fuel, and preferably a turbulent flow of fuel, initiate the aforementioned chemical conditioning and catalytic reaction that effectuates the conditioning of the fuel. Unlike alternative combinations of elements, these specific preferred elements, present so as to influence the fuel flow, provide significantly enhanced and unexpected results in the extent to which the chemical composition of the fuel is modified and enhanced. Furthermore, these particular metallic elements could be incorporated into the assembly 10 of the present invention in a variety of manners, such as by providing a plurality of differing metal shavings formed of the various metallic elements.

Also, as will be described hereinafter with regard to the embodiment of FIG. 4, one preferred embodiment the various components of the fuel conditioning assembly 10 are formed such that the necessary combination of metallic elements are disposed to influence the fuel. In particular, in one preferred embodiment, all or part of the housing 20 is formed of copper such that as the fuel flows through the flow through passage 25 it contacts the housing and is influenced by the copper composition thereof. Moreover, the metallic shavings 50, in this preferred embodiment, are stainless steel metal shavings. As a result, as the fuel flows in its turbulent fashion through the metal shavings 50, it comes into contact with the shavings 50 and is influenced by the stainless steel composition thereof. Also, in one preferred embodiment, the mesh 55 is formed of aluminum. Accordingly, as the fuel flows through the mesh 55 and into the metal shavings 50, it comes into contact with the aluminum composition of the mesh 55 and is influenced thereby. It is the influence of that combination of elements, in the preferred embodiment, that substantially leads to the enhanced chemical and catalytic reaction which conditions the fuel.

Figure 4:
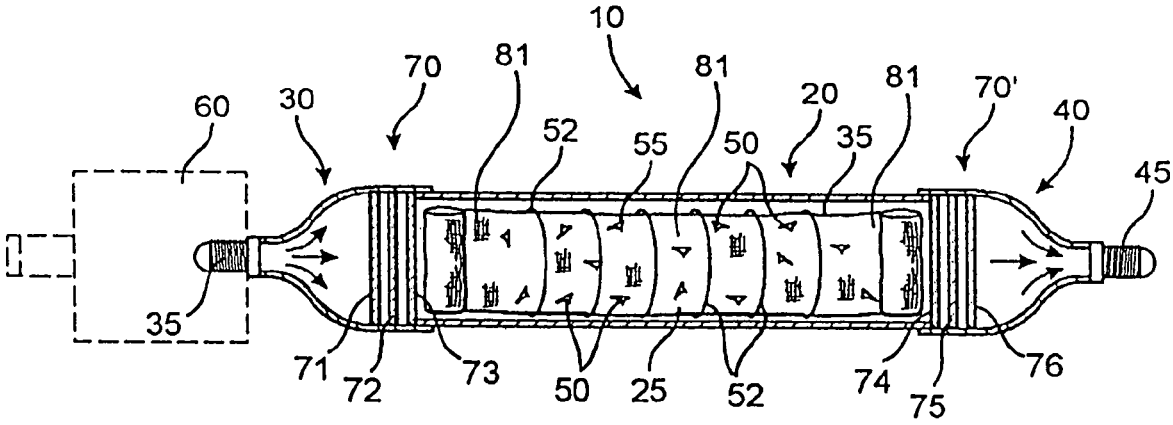
FIG. 4 is a cross-sectional side view of another embodiment of the fuel conditioning assembly.

Turning to FIG. 4, in yet another preferred embodiment at least one, but preferably a plurality of screen elements 70, 70' are provided in operative association with the housing 20. Preferably, the screen elements 70, 70' are disposed at both the inlet end 30 and the outlet end 40 of the housing 20 so as to define inlet screen elements 70 and outlet screen elements 70'. As such, the fuel flow into and out of the housing 20 must necessarily pass through the screens 70 and 70'. Screens 70 and 70' could be formed of a material which does not cause a catalytic effect but merely filters the fuel. However, in the preferred embodiment of FIG. 4, at least one and preferably both the inlet and outlet screen elements 70, 70' at least partially comprise and thereby define a part of the conditioning assembly.

In addition, it is preferred that at least three screen elements are associated with each of the inlet and outlet screen elements 70 and 701. As represented, each of the screen elements 71, 72, 73 and 74, 75, 76, which respectively comprise the inlet and outlet screen elements 70 and 70' are preferably formed of a different one of the metallic elements which cause the catalytic effect. Such elements include copper, aluminum, and stainless steel. For example, it is preferred that three screen elements 71, 72 and 73 comprise the inlet screen elements 70 and be formed of a different material from one another, while three screen elements 74, 75, and 76 formed of different materials from one another define the outlet screen elements 70'. As a result the catalytic effect in the fuel, and therefore the fuel conditioning, if not entirely achieved at the inlet end 30 of the housing 20, can be further enhanced at the outlet end 40 of the housing 20.

Of course, other embodiments of the present invention comprise the turbulence assembly and other elements within the housing 20 being formed of other metallic or non-metallic materials, with the copper, aluminum, and stainless steel elements being the primary elements that treat the fuel by causing a catalytic effect. As a result, other treatment elements may be provided for alternative or additional treatment of the fuel in other or increased ways, or other material elements used merely to generate turbulence and define the various components of the housing 20 may be included.

Accordingly, the structural features of the turbulence assembly particularly, but not exclusively, including the inlet and outlet screen elements 70 and 70' additionally serve to create an "atomization" and dispersion of the fuel, regardless of its category. Such atomization, caused by the additional turbulence, results in the fuel being dispersed into small droplets having high surface areas. This additional turbulent mixing of the fuel produces a lowered fuel vapor density thereby providing a more complete combustion. As indicated above, a more complete combustion of the fuel prior to exhaust reduces the formation of contaminants in the exhaust and aids in a reduction of toxic, volatile organic compounds (VOC) such as, but not necessarily limited to benzene, toluene, xylene acetone, etc. Such VOC materials are of course recognized as typical byproducts of fuel combustion.

In yet another embodiment of the present invention, the elements that come into contact with the fuel and thereby cause a catalytic effect may include any combination of the elements: copper, aluminum, stainless steel, titanium, magnesium, barium, calcium, iron, Cerium, Lanthanum, Zirconium platinum and/or palladium. As such, one or more of the above elements may define the screens, the metal shavings, the housing, the mesh, the wires, welds, etc., so long as conditioning contact with the fuel is at least minimally achieved. For example, looking further to FIG. 4, one or more pellets 81 are defined within the flow through passage. These pellets 81 may be between 1 to 4 ounces in size, and between three to five pellets may be disposed at each end of the flow through passage, generally near the inlet and outlet ends, and possibly in the middle of the flow through passage. In this regard, however, it is recognized that larger, smaller, fewer number or greater number of pellets 81 may be employed and/or spaced throughout the flow through passage 25 so long as sufficient quantities of the elements are present to react with the fuel.

By way of further example, in the illustrated embodiment of FIG. 4, the screens 71, 72, 73 are formed from the copper, aluminum, stainless steel. As a result, one or more of the remaining elements, namely titanium, magnesium, barium, calcium, iron, Cerium, Lanthanum, Zirconium, platinum and/or palladium may define secondary elements that comprise the pellets and/or remaining structural aspects of the assembly 10. Of course, some interchangeability of the elements between the various components, and/or combinations of elements within a certain component, such as each pellet 81, are also considered to be included within the intended scope of the present invention.

Turning to FIG. 5, in yet another embodiment of the present invention, an elongate segment 56 is preferably provided and extends generally along a length of the flow through passage. This elongate segment 56 is preferably a continuous segment, such as an elongate wire, and may be formed of a metallic element to aid in the conditioning process. Further, in the embodiment of FIG. 5, the elongate segment 56 is formed of copper, the mesh or screen 55 is formed of aluminum and contains the stainless steel particulates 50 therein, although a reverse composition (i.e. the aluminum, stainless steel or copper can comprise all or part of any of the mesh, wire or particulates) and/or composite metal composition is possible. In such an embodiment, and especially when the elongate segment 56 is formed of copper, the catalytic reaction caused at least by the interaction of the copper, stainless steel, and aluminum that engage the fuel results in the formation of an electrostatic charge, the elongate segment 56 helping to convey the electrostatic charge throughout the flow through passage to maximize its impact on the fuel as it flows there through.

Additionally, in the embodiment of FIG. 5, in addition to the copper, aluminum and stainless steel that comprise the screen 55, particulates 50 and elongate segment 56, additional metallic element(s), characterized for clarity as secondary element(s) may also be provided and introduced into the flow through passage so as to enhance conditioning of the fuel. As indicated, these metallic element(s) comprise one or more elements from the group consisting of: titanium, magnesium, barium, calcium, iron, cerium, lanthanum, zirconium, platinum and/or palladium. Further, so as to ensure effective conditioning interaction within the flow through passage, the secondary element(s) are preferably maintained in a select, desired location within the flow through passage by a binding element 58. In the illustrated embodiment, the binding element 58 is formed of an epoxy type material that contains the secondary element(s) therein in a reactive position. Moreover, in the preferred embodiment, the binding element 58 may be disposed in a vicinity of both the inlet and the outlet so as to maximize conditioning effects to be produced.

Since many modifications, variations, and changes in detail can be made to the described preferred embodiment of the invention, it is intended that all matters in the foregoing description and shown in the accompanying drawings be interpreted as illustrative and within the scope and spirit of this invention, and not in a limiting sense. Thus, the scope of the invention should be determined by the appended claims and their legal equivalents.

Now that the invention has been described,

What is claimed is:

1. A fuel conditioning assembly comprising:

a housing, said housing including an inlet, an outlet, and a flow through passage;

said inlet coupled with a fuel supply and structured to receive fuel flow there through into said flow through passage;

a quantity of copper, aluminum, and stainless steel structured to come into contact with said fuel flow resulting in the generation of an electrostatic charge which at least temporarily conditions the fuel and substantially increasing a fuel burn efficiency thereof; and said copper including an elongate segment extending substantially along a length of said flow through passage so as to conduct said electrostatic charge throughout said flow through passage.

2. A fuel conditioning assembly as recited in claim 1 further comprising at least one secondary element selected from the group consisting of: titanium, magnesium, barium, calcium, iron, cerium, lanthanum, zirconium, platinum and/or palladium, disposed in said flow through passage and structured to come into contact with said fuel flow.

3. A fuel conditioning assembly as recited in claim 2 wherein said secondary element is disposed in a vicinity of said inlet and said outlet.

4. A fuel conditioning assembly as recited in claim 2 wherein said secondary element is maintained in a select location within said housing by a binding element.

5. A fuel conditioning assembly as recited in claim 4 wherein said binding element comprises epoxy.

6. A fuel conditioning assembly as recited in claim 1 further comprising a screen disposed in line with said fuel flow through said flow through passage of said housing.

7. A fuel conditioning assembly as recited in claim 6 wherein said elongate segment is at least partially wrapped around said screen.

8. A fuel conditioning assembly as recited in claim 6 wherein said screen is formed of aluminum.

9. A fuel conditioning assembly as recited in claim 6 further including a turbulence assembly structured and disposed to create a turbulent flow of the fuel through said flow through passage.

10. A fuel conditioning assembly as recited in claim 9 wherein said turbulence assembly is formed of stainless steel.

11. A fuel conditioning assembly as recited in claim 9 wherein said turbulence assembly is disposed in said screen.

12. A fuel conditioning assembly as recited in claim 11 wherein said elongate segment is at least partially wrapped around said screen.

13. A fuel conditioning assembly as recited in claim 12 wherein said turbulence assembly is formed of stainless steel.

14. A fuel conditioning assembly as recited in claim 13 wherein said screen is formed of aluminum.

15. A fuel conditioning assembly as recited in claim 14 further comprising at least one secondary element selected from the group consisting of: titanium, magnesium, barium, calcium, iron, cerium, lanthanum, zirconium, platinum and/or palladium, disposed in said flow through passage and structured to come into contact with said fuel flow.

16. A fuel conditioning assembly comprising:

a housing, said housing including an inlet, an outlet, and a flow through passage;

said inlet coupled with a fuel supply and structured to receive fuel flow there through into said flow through passage;

a quantity of copper, aluminum, and stainless steel structured to come into contact with said fuel flow resulting in the generation of an electrostatic charge which at least temporarily conditions the fuel and substantially increasing a fuel burn efficiency thereof;

at least one secondary element selected from the group consisting of: titanium, magnesium, barium, calcium, iron, cerium, lanthanum, zirconium, platinum and/or palladium, disposed in said flow through passage and structured to come into contact with said fuel flow, and said secondary element maintained in a select location within said housing by a binding element.

17. A fuel conditioning assembly as recited in claim 16 wherein said binding element comprises epoxy.

18. A fuel conditioning assembly as recited in claim 16 wherein said binding element is structured to maintain said secondary element in a vicinity of both said inlet and said outlet.

* * * * *